US005129440A

United States Patent [19]

Colson

[11] Patent Number: 5,129,440

[45] Date of Patent: Jul. 14, 1992

[54] ROMAN SHADE

[75] Inventor: Wendell B. Colson, Boulder, Colo.

[73] Assignee: Hunter Douglas Inc., Upper Saddle River, N.J.

[21] Appl. No.: 520,933

[22] Filed: May 9, 1990

[51] Int. Cl.[5] ..... E06B 9/06

[52] U.S. Cl. ..... 160/84.1; 156/197; 428/116

[58] Field of Search ..... 160/84.1, 348; 156/197; 428/116

[56] References Cited

U.S. PATENT DOCUMENTS 4,194,550 3/1980 Hopper .
4,347,887 9/1982 Brown .
4,450,027 5/1984 Colson .
4,631,217 12/1986 Anderson .
4,673,600 6/1987 Anderson .
4,676,855 6/1987 Anderson .
4,677,013 6/1987 Anderson .
4,685,986 8/1987 Anderson .
4,846,243 7/1989 Schneider ..... 160/230 X
4,849,039 7/1989 Colson et al. ..... 156/197

FOREIGN PATENT DOCUMENTS 6706563 11/1968 Netherlands .

*Primary Examiner*—Blair M. Johnson
*Attorney, Agent, or Firm*—Fleit, Jacobson, Cohn, Price, Holman & Stern

[57] ABSTRACT

An improved expandable and contractible window covering comprising an assembly of elongated cells is disclosed. Each cell is formed by folding a strip of material and joining an edge to the next adjacent cell. The rear wall of the cell comprises less material than the hanging front wall flap of the cell, and the material of the cell is chosen to be relatively soft and flexible, so that the hanging front wall flap of each cell droops downwardly at least to the juncture with the adjacent lower cell.

20 Claims, 7 Drawing Sheets

FIG. 1
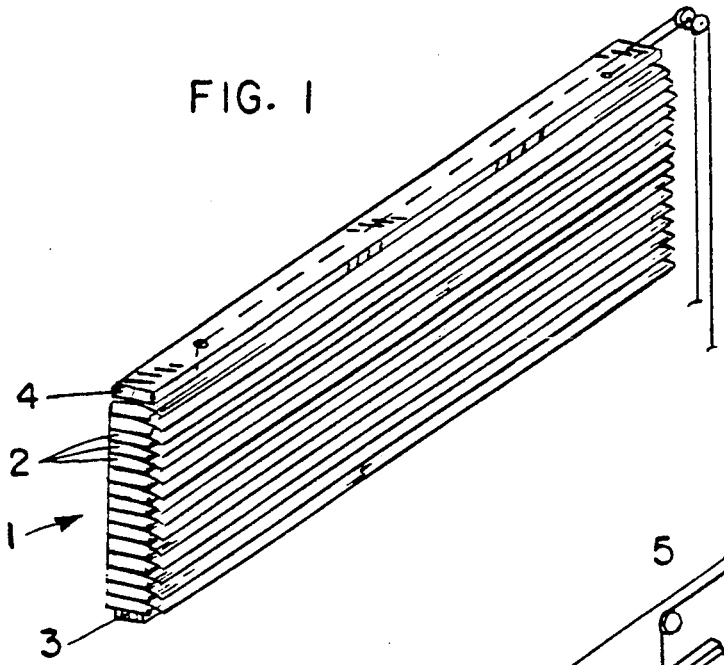
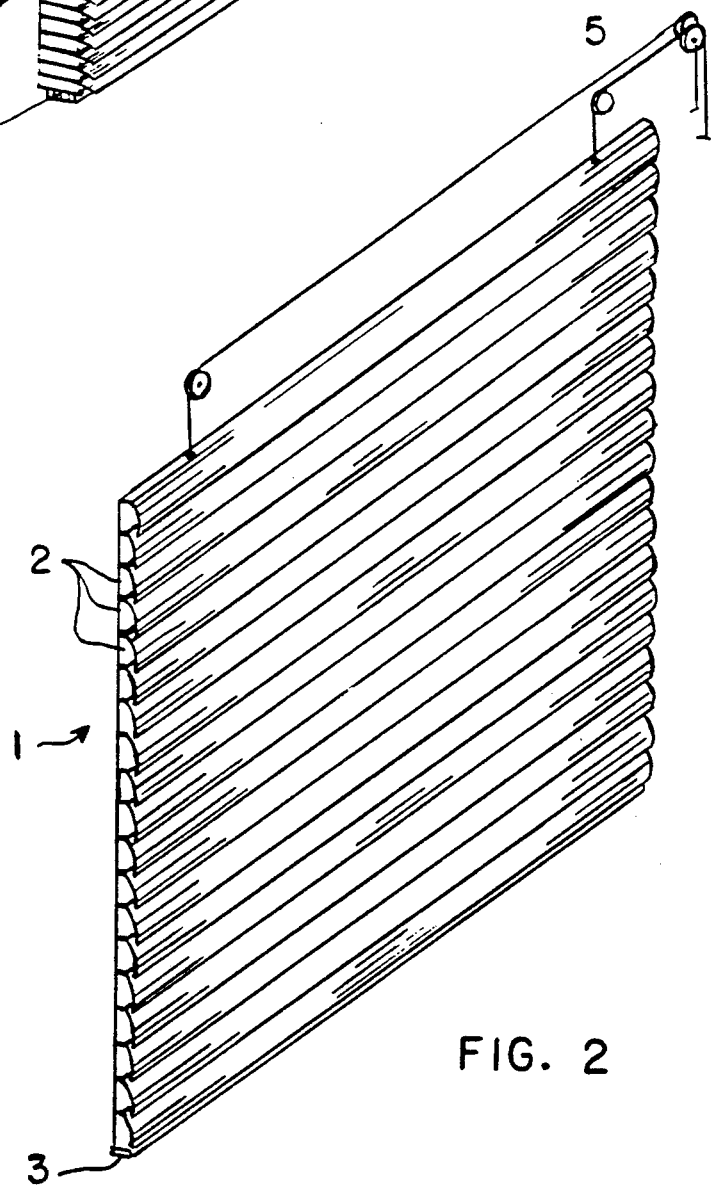
FIG. 2

ROMAN SHADE

FIELD OF THE INVENTION

This invention relates to an improved window covering More particularly, this invention relates to an improved window covering of the Roman shade type wherein one side of the shade, typically arranged so that this side is toward the interior of a room, consists of a number of loosely hanging flaps, which may comprise looped portions, and in which each of these hanging flaps forms the front wall of a substantially tubular cell extending horizontally across the width of the shade, thus creating a thermal insulating window covering with an extremely attractive appearance.

BACKGROUND OF THE INVENTION

Several publications show cellular shades, wherein a fabric material is formed to define parallel tubular cells extending horizontally across the width of the shade. Air within each of the cells only circulates minimally, such that when expanded the shade provides good thermal insulation.

It is of course desirable to make the physical appearance of the shade as attractive as possible. Similarly, it is desirable to make such shades as economically as possible, which requires both that a minimal amount of material be used to form each cell and that the manufacturing process be as expeditious as possible.

Various exemplary prior art disclosures include the following:

French patent 1,568,745 to Landa (which has Netherlands and West German equivalents) discloses a screen wherein a plurality of strips of a fabric material are folded about fold lines extending longitudinally and bonded together, the two edges of each strip being bonded to the center of the successive strip, to form a shade consisting of a plurality of tubular cells. The Landa screen is intended to be used such that the cells extend vertically.

U.S. Pat. No. 4,347,887 to Brown shows a "thermal shutter". A wide band of material is folded transversely to form a double row column of adjacent cells. The cells are adhesively bonded to one another. The Brown structure is symmetrical, so that both sides of the shade thus formed have essentially the same appearance.

U.S. Pat. No. 4,450,027 to Colson shows a method and apparatus for fabricating a multiple cell shade wherein a continuous relatively narrow strip of fabric is sharply creased longitudinally in order to define pleats in the shade material. A U-shaped cell structure is thus formed. Successive cells are assembled by applying an adhesive to opposed edges of the folded strips, and adhering each formed strip to the strip making up the next preceding cell. The Colson patent discloses strips that are sharply creased to facilitate the formation of the cells.

U.S. Pat. Nos. 4,631,217, 4,676,855 and 4,677,013 to Anderson show in FIG. 3 a shade of asymmetrical construction. A rear wall section of each cell is essentially straight or linear when the shade is in its expanded position. The height of these rear wall sections thus defines the spacing of the adjacent cells, while the front of each cell, containing more material, maintains a non linear shape. In the Anderson patents the method of forming the expandable and collapsible shade consists in providing an assembly of horizontal parallel cells, by forming the cell structure from a material folded into a Z-shape rather than the U-shape shown in the Colson patent.

U.S. Pat. Nos. 4,673,600 and 4,685,986 to Anderson disclose a honeycomb structure and method for its production. The structure and method for its production. The structure is composed of two pleated sheets of material joined along opposing pleats. One embodiment shows an asymmetrical construction having a straight rear face and a pleated front face while in the expanded condition.

U.S. Pat. No. 4,846,243 to Schneider shows a foldable window covering formed of a wide relatively soft material folded transversely, as in the Brown patent, to yield a collapsible shade. The front surface of the shade consists of a number of drooping loops formed by doubling the material back on itself. The successive cells are spaced in the expanded position of the shade by a relatively vertical rear wall section of each cell, and the size and shape of the loops depend on the location of the seams by which adjacent cells are joined. The Schneider construction is relatively complex and requires a large amount of material per cell. Furthermore, since the Schneider shade is formed of a wide strip of material folded transversely, this limits the width of the shade which can thus be formed to the width of the stock material available. The need to transversely fold a wide sheet of material continuously across its width also requires precise alignment and control of the entire sheet of material.

SUMMARY OF THE INVENTION

The present invention provides an improved Roman shade consisting of a number of parallel generally tubular cells, each having a front wall which consists of a hanging flap formed of a soft material which is essentially uncreased in the finished product. With this construction, the flaps droop somewhat, providing an aesthetically pleasing appearance, while the rear wall of each cell is essentially linear when the shade is in the expanded state, such that the height of the rear wall determines the spacing of adjacent overlying cells.

The Roman shade of the present invention does not use excessive material per cell. Also, it is formed of a relatively narrow strip of material folded longitudinally, such that the width of the shade is not limited by the width of stock materials available. The shade can be manufactured using essentially the methods and apparatus, as shown, for example, in the Colson and Anderson patents.

The improved Roman shade consists of a number of parallel cells with each cell including a rear wall portion which is substantially vertical or linear when the shade is in its expanded state, a bottom portion extending forwardly from the back wall, and a hanging front wall flap portion defining a generally drooping curved surface extending in a curve from a top portion of the cell downwardly and away from the rear wall portion. The cell front surface may comprise a loop of material, and provides an extremely attractive appearance.

BRIEF DESCRIPTION OF THE DRAWINGS

FIG. 1 shows a first embodiment of the shade of the invention in its nearly collapsed state;

FIG. 2 shows the shade of FIG. 1 in its expanded state;

DESCRIPTION OF THE PREFERRED EMBODIMENTS

Figure 3:
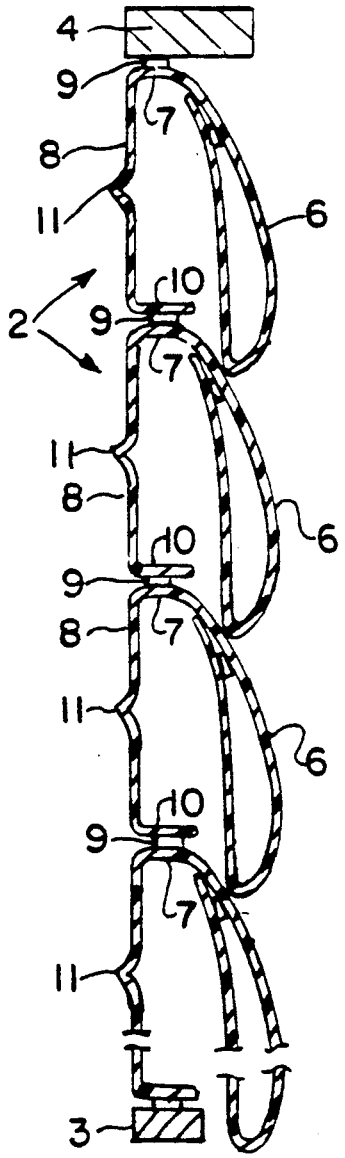
FIG. 3 is a cross-sectional view of one embodiment of the invention in the expanded state showing the individual cell structure of the shade, wherein the front and back faces of the cells are comprised of the same strip of material.

As shown in FIGS. 1 and 2, the shade comprises an assembly 1 made up of an integral row of parallelly arranged generally tubular cells 2, one on top of the other. The assembly of cells 2 is fitted with a bottom rail 3 connected to a lowermost cell and a head rail 4 connected to an uppermost cell (omitted from FIG. 2 for clarity). The assembly is adapted to be fitted into a window opening, for example, with the longitudinal cell axis transverse to the direction of expansion and contraction of the assembly. The motion of the shade between the collapsed state of FIG. 1 and the expanded state of FIG. 2 is controlled by control cords 5 extending from the bottom rail 3 upwardly through the cells 2, and into the head rail 4. The cords are directed by generally conventional control pulleys, guides and the like, and are engaged by a conventional locking dog engaging mechanism (not shown).

As typically used, these shades are disposed between opposed surfaces of the casing of a window. The width of the shade is preferably chosen so that the ends of the cells approach the casing closely, such that little air flow takes place through the cells. In this way the air mass in each cell is essentially static, whereby the cells of air form a very effective thermal insulation.

Figure 4:
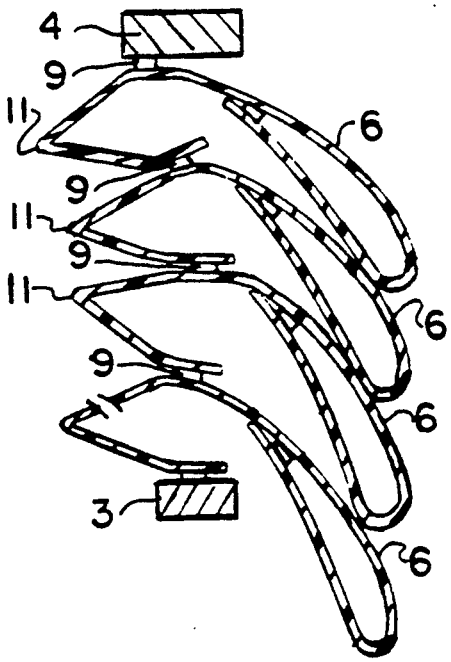
FIG. 4 is a cross-sectional view of the embodiment shown in FIG. 3 in the nearly collapsed state.

As indicated in FIG. 3 the final cells 2 are formed from a plurality of superimposed strips of flexible fabric material joined to one another to make up each cell structure 2. Each cell 2 has a cross-sectional shape including a droopy hanging front wall flap 6 extending downwardly and outwardly from a top portion 7 of each cell. The front wall flaps define the front faces of the cells, i.e., those portions which are visible when the shade is in use. Preferably, the front wall flaps 6 are of sufficient height compared to the rear wall 8 so that the front wall flap of each cell droops downwardly at least as far as the juncture between the cell of which it is a part and the immediately adjacent lower cell, when the shade is in the expanded state. Accordingly, when the shade is in its collapsed state as shown in FIGS. 1 and 4, the drooping front wall flap 6 of each cell extends well below the adjacent lower cell.

In the embodiment of the invention shown in FIG. 3, the strip material is formed across its width into the front wall flap 6 and rear wall 8 of each cell. One longitudinal side of the strip makes up the front of a cell, and the other longitudinal side of the strip makes up the rear of the same cell. Other embodiments of this construction appear in FIGS. 5a-5f.

Figure 6:
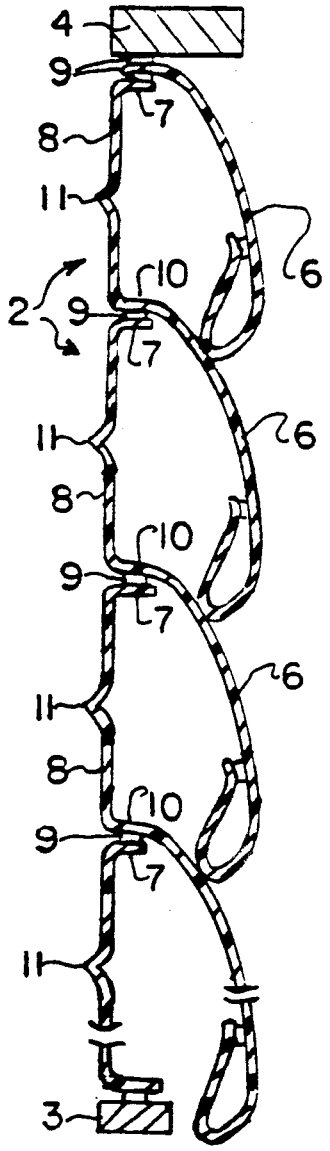
FIG. 6 is a cross-sectional view of still another embodiment of the invention in the expanded state showing the individual cell structure of the shade, in which the front face of one cell and back face of an adjacent upper cell are comprised of the same strip of material.
Figure 7:
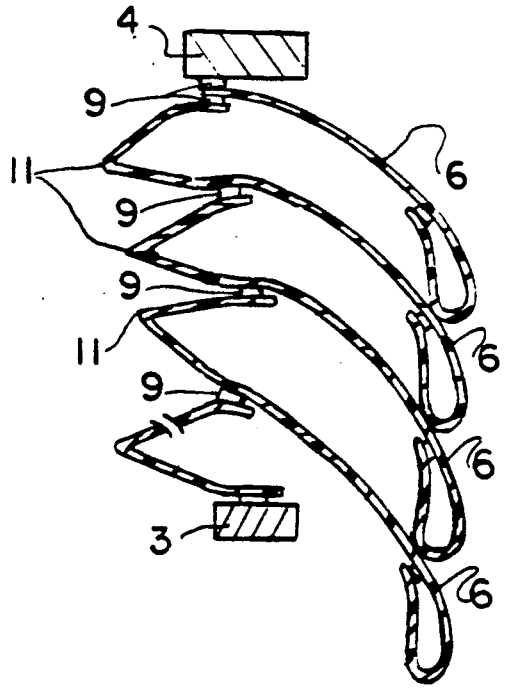
FIG. 7 is a cross-sectional view of the embodiment shown in FIG. 6 in the nearly collapsed state.

According to the embodiment of the present invention shown in FIG. 6, each completed cell 2 is formed of two strips of material. One strip defines a front wall flap portion 6 and extends downwardly from a top portion 7 of the cell. Another separate strip defines rear wall portion 8 of this cell. In this construction, the back of each cell is formed of the same strip of material as the front wall flap portion of the immediately adjacent lower cell. Each cell is joined by an adhesive bead 9 to the immediately adjacent upper and lower cell. Other embodiments of this construction appear in FIGS. 8*a*–8*f*. FIG. 7 shows the embodiment of FIG. 6 in the nearly collapsed state.

Each cell therefore comprises at least one longitudinal edge portion of one of said superimposed strips, and the number of strips is at least equal to the number of cells.

Figure 5A:
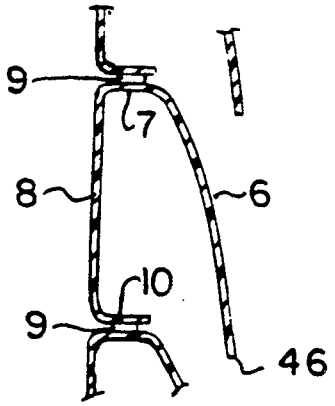
FIGS. 5*a* through 5*f* show cross-sectional views of further embodiments of the invention similar to that shown in FIG. 3.
Figure 5B:
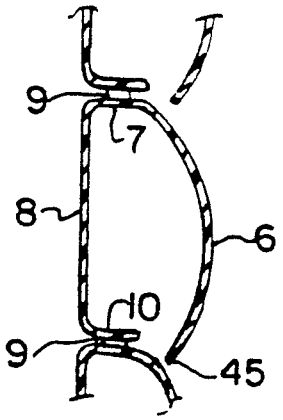
Figure 5C:
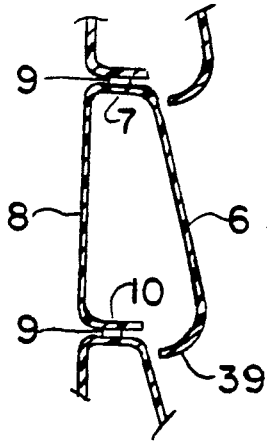
Figure 8A:
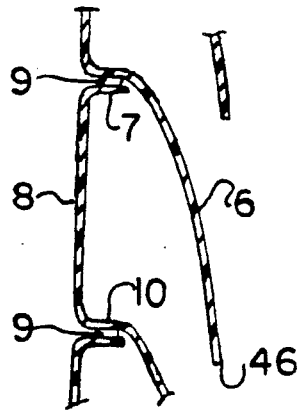
FIGS. 8*a* through 8*f* show cross-sectional views of various embodiments of the invention similar to that shown in FIG. 6.
Figure 8B:
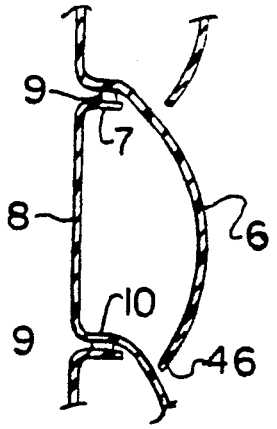
Figure 8C:
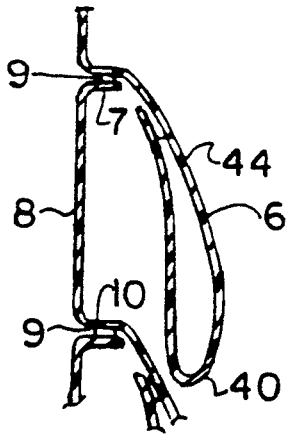
Figure 8D:
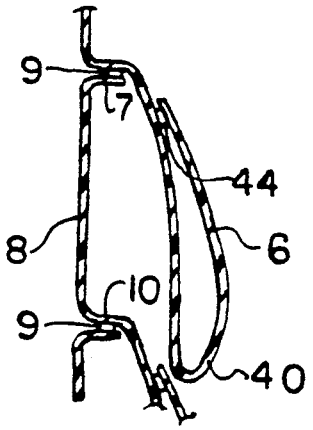
Figure 8E:
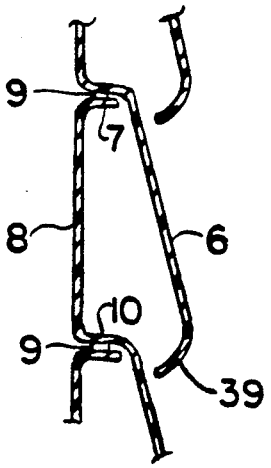
Figure 8F:
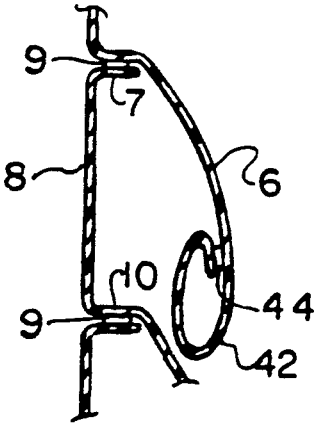

A number of embodiments of the invention may be obtained by varying the shape and structure of the hanging front wall portion. Three principle configurations are described here, and depicted in FIGS. 5 and 8. The first is a freely hanging front wall portion terminating at a lower edge, shown in FIGS. 5*a*–5*c* and 8*a*–8*c*. The front wall here may be curved as shown in FIGS. 5*b* and 8*b*, for aesthetic reasons. It may also be substantially straight with a curved portion at the bottom, as shown in FIGS. 5*c* and 8*e*, with the freely hanging edge 39 pointing toward the rear of the shade.

Figure 5D:
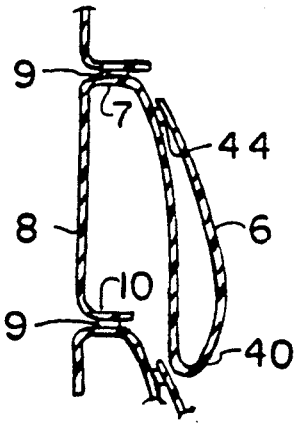
Figure 5E:
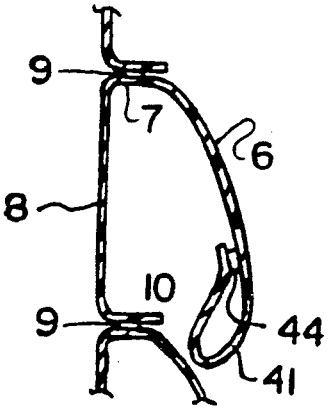
Figure 5F:
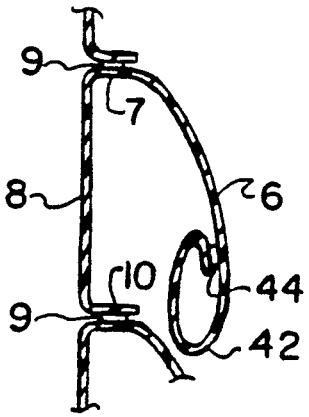

A second embodiment has a loop, which is achieved by doubling the front wall material over itself and joining it to itself toward the top of the front wall portion. The front wall material may be looped forwardly over itself, as shown in FIGS. 5*d* and 8*d*, or it may be looped rearwardly over itself, as shown in FIGS. 3 and 8*c*. This shape of front wall portion of course requires that a wider edge of unfolded material emerge from the initial strip-folding of the Colson/Anderson processes used to produce the shades, as discussed below, and that the loop shape be fastened along the strip, preferably by adhesive.

Finally, the front wall portion may include an abbreviated loop toward its bottom, as shown in FIGS. 6, 5*e*–5*f*, and 8*f*. Again the material may be looped forwardly or rearwardly over itself. Further, the material may be joined across two locations on the same face of the material to form loop 41 as in FIGS. 5*e* and 6, or a more bulbous loop 42 shown in FIGS. 5*f* and 8*f* may be formed by joining one face of the material to the other face.

The front wall portion in any of these embodiments is independent of the juncture of each cell to adjacent cells. That is, the construction of the front wall, and hence the appearance of the shade, may be varied without regard for the juncture between cells. Thus, the numerous embodiments shown in FIGS. 5*a*–5*f* and 8*a*–8*f* may be reached from the same basic cell structure, as indicated earlier.

In the completed cell, the construction is asymmetrical in that the front wall flap 6 is preferably of substantially greater height than the rear wall portion 8, and may be shaped in a number of aesthetically pleasing ways. Typically, the lowest part of the front wall portion is level or beneath the juncture of the cell with the directly adjacent lower cell. Preferably, the front wall portion is freely hanging and independent of other parts of the cells, but it would be possible to connect the front wall portion to a lower cell, for example, without departing from the scope of the invention. Also, the front wall portion is not creased perceptibly when the shade is in use, principally for aesthetic reasons.

As also indicated in FIGS. 3 and 6, the rear wall portion 8 may include a longitudinal crease 11 extending generally along its center. Such a crease can be formed by pressure and heat applied during the formation of the strip into a cell, as described in detail in Colson U.S. Pat. No. 4,450,027. The crease 11 serves dual functions. A first function is to provide a reference surface by which the strip of material can be guided during the fabrication process. The crease 11 also guides the collapse of the cell, such that the cells collapse uniformly and evenly.

In the expanded state of the shade of the invention shown in FIGS. 3 and 6, the height of the rear wall 8 effectively defines the spacing of the cells 2. In this way the cells 2 can be made of predetermined height, to effect the desired appearance. The extent of cell expansion of the assembly is thus controlled by the height of the rear wall portion of each cell.

FIGS. 4 and 7 show the shades of FIGS. 3 and 6 in the nearly collapsed state. If used, the creases 11 at the rear of each cell serve to ensure uniform collapsing of the cells. The hanging front wall portions 6 of each cell extend substantially over the next lower cells.

Temporary creases may be used to assist in the manufacture of the shade of the invention. A temporary crease can be provided in a number of ways. For example, in order to form a permanent crease in a polyester film material, it is necessary to heat the material to a given temperature while folding it and to press it against a hard surface to form a sharply set crease. However, a temporary crease can be formed during the manufacturing process by pressure with a limited amount of heating. If the shade is then hung and allowed to expand, and the crease is heated above a transition temperature, the polyester material will tend to return to its original shape, so that the temporary crease will effectively disappear.

Similarly, a cotton fabric with a water soluble sizing such as starch can be used to form the shade of the invention. Such a sized cotton fabric can be creased as if it were paper. However, the starch can be dissolved if the shade is subsequently hung out and wetted, removing the creases. Similar techniques may be useful with polyester and synthetic materials.

Finally, a temporary adhesive can be applied to each strip inside the fold defining the front wall during the assembly process, causing the two sides of the front wall to be temporarily bonded, and holding the cell flat for the manufacturing process without imparting a permanent crease. When the shade has been completed, it can be hung out and the adhesive removed. If a water-soluble adhesive is used, it can simply be washed away. Similarly, the two sides of the front and rear walls can be temporarily bonded during assembly using a known heat sensitive adhesive which self-adheres at temperatures, for example, up to 200° F. If this is used to hold the strips flat during stacking, the temporary creases thus formed can be removed by heating the assembly and pulling the temporary creases out.

It is possible to form the shade of the invention from materials which do not crease, such as elastomeric materials.

As indicated above, it is an object of the preferred embodiment of the invention to provide a shade having cells each comprising smooth and uncreased, curved, hanging front wall flap portions in which permanent creases are avoided during assembly. This may be achieved through use of the Colson process of U.S. Pat. No. 4,450,027 or the Colson process as modified by Anderson and disclosed in U.S. Pat. No. 4,676,855.

Figure 10:
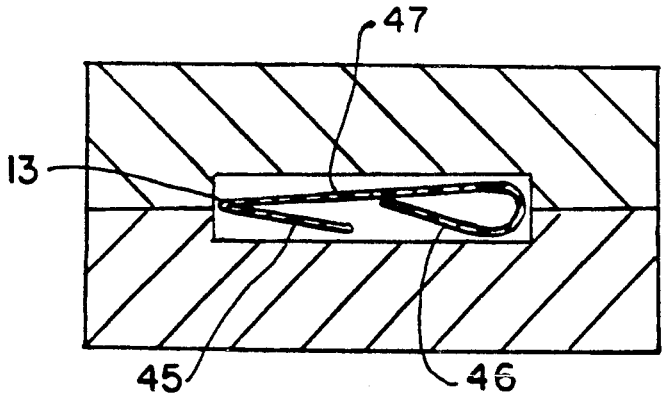
FIG. 10 is a cross-sectional view, taken along lines 10—10 of 8, of the strip material after the initial folding step for forming the embodiment of FIG. 3.

The basic method of forming the assembled cell structures of the embodiment of FIG. 3 includes an initial step of folding the strip of material into a form as shown in FIG. 10. The basic method is fully disclosed, most particularly at column 4, line 4 through column 9, line 55, in the Colson U.S. Pat. No. 4,450,027, which patent is incorporated herein by reference.

In the Colson process each strip of material is typically creased longitudinally along lines parallel to the longitudinal strip axis to create front and rear edge portions which are folded over a mid-portion to essentially meet each other. Next, beads of adhesive are applied along the edges of the creased strips of material, and they are stacked, one on top of the other, on a stacking arm. Pressure is applied to ensure that the adhesive bond is properly formed. According to the present invention, it is desired to avoid creasing the front edge portions and only crease the rear edge portions. The second longitudinal edge is then left unconnected to form the front wall flap portion of the cells. The cells are joined by applying adhesive to only the one folded edge portion and stacking the material. This leaves the free edge portion to form the front wall flap, which can be shaped, if desired, either as part of the strip-forming process of the Colson patent, or by die-forming subsequent to manufacture of a stacked shade having creased rear edges and unformed front walls. The rear wall portion is formed by the folded rear edge and at least part of the mid-portion.

Figure 9:
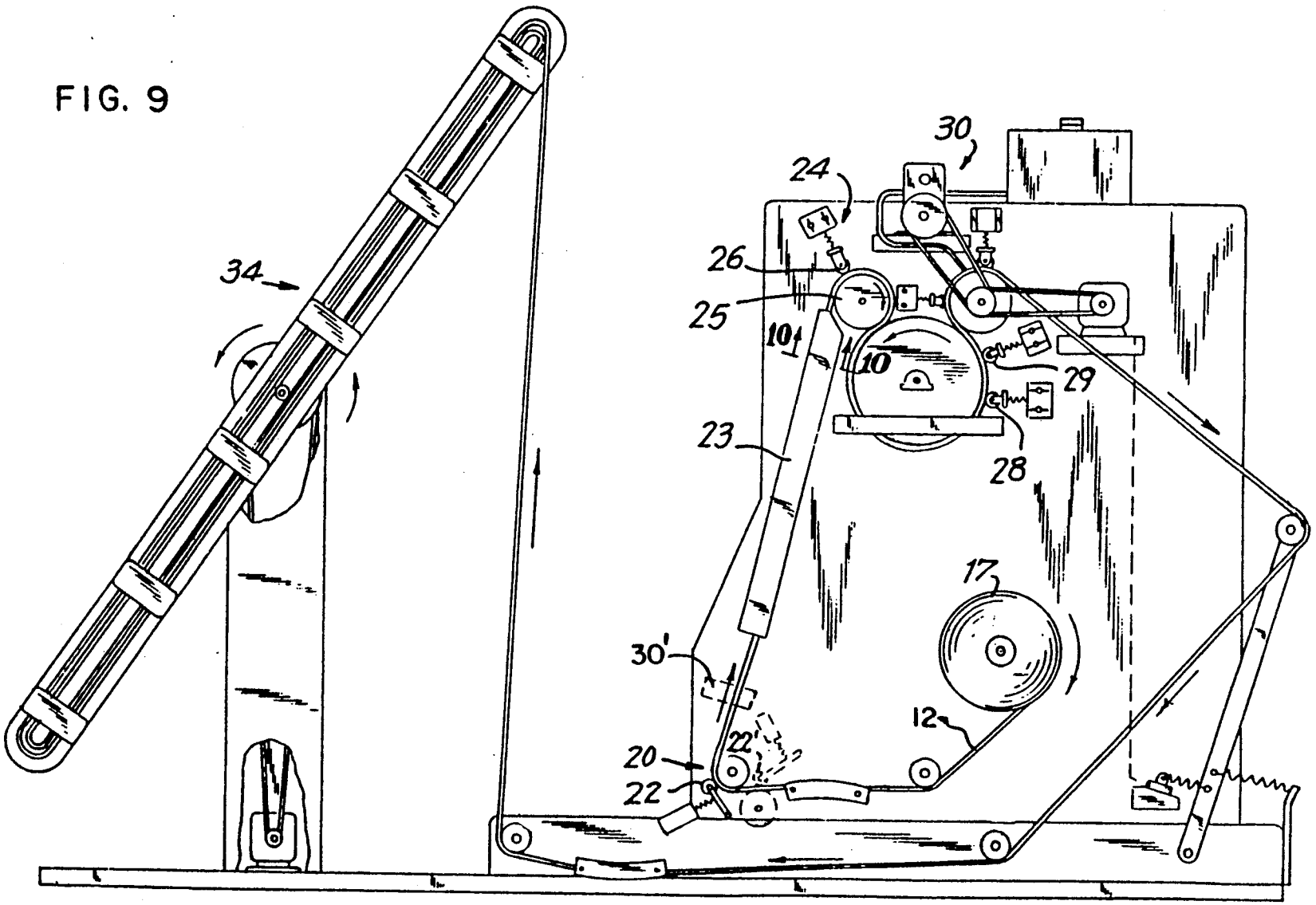
FIG. 9 is a plan view of a suitable apparatus for fabricating the shade structure according to the method of the present invention.
Figure 11:
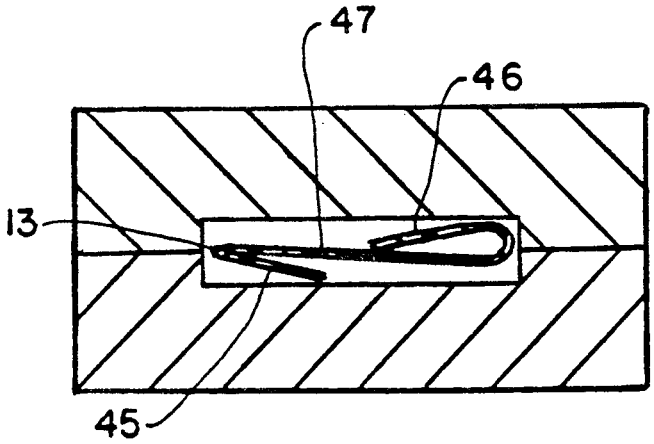
FIGS. 11 is a cross-sectional view, similar to FIG. 10, of the strip material after the initial folding step for forming the embodiment shown in FIG. 6.
Figure 12:
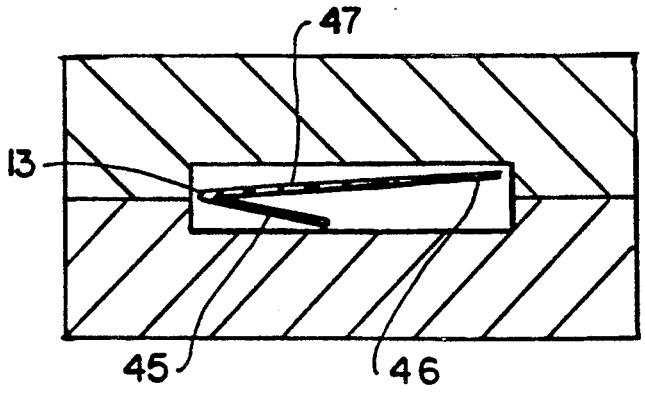
FIG. 12 is a cross-sectional view, similar to FIG. 10, of the strip material after the initial folding step for forming the embodiment shown in FIGS. 5*a*14 5*c* and 8*a*–8*c*.

FIG. 9 of the present application show the apparatus of the '027 patent and as modified by Anderson as used in accordance with the teachings of a present invention. As shown in FIG. 9 supply of foldable material 12 is provided by the roll 17. Creasing, to the extent desired as discussed above, is initiated by the creaser assembly 20. As the length of material 12 passes through the creaser assembly, a crease 13 is formed in the material on one side thereof. After leaving the creaser assembly 20, the length of material 12 is fed through a folding mechanism 23. This mechanism may be constructed in any suitable manner to fold the length of material longitudinally along the crease line 13. The folding is such as to fold the longitudinal rear edge 45 over one side of the mid-portion 47 of the length of material. Shaping of the other longitudinal edge 46, where desired, is discussed below. The folding of edge 45 is done progressively as the length of material is fed through the folding mechanism 23. The folded condition of the length of material as it exits from the folding mechanism 23 is shown in FIGS. 10–12. As there seen, the folding of edge 45 is generally in a sideways V pattern.

After folding of the material, it is directed through a crimper assembly 24 to tightly press and squeeze the material so as to form a permanent fold along this line. Depending on the nature of the material, this crimper may or may not be necessary. Roller 22 and the cooperating press rollers 28 and 29 may be used to apply heat and rolling pressure across the material to set the desired crimp permanently at a sharp angle.

An adhesive applicator 30 is provided for progressively applying the adhesive longitudinally of the length of material. The adhesive is applied in a continuous length as disclosed in the '027 patent to provide one or more beads 9.

After the adhesive beads 9 are applied progressively to the length of material as it moves through the forming apparatus, the material is led to a stacking area where it is wound about a stacking arm 34 and into a continuous loop with successive portions of the length overlying preceding portions. This forms a plurality of parallelly arranged, superimposed, sequential layers of folded length of material on the stacking arm. During this stacking operation, the lengths of adhesive beads 9 on the folded material are pressed into engagement with the facing side of the folded material to connect the sequential layers together along connection lines running lengthwise of the strip on the rear edge portion and mid-portion of adjacent lengths of strip material.

The Colson process shown in U.S. Pat. No. 4,450,027 is generally useful in forming cells where one edge of the strip material is shaped into the front wall flap portion over the same side of the strip that the other edge is folded over. Such cell structures are shown in FIGS. 3, 5*a*–5*c*, 5*e*–5*f*, and 8*d*.

Alternatively, the modification of the Colson process shown in Anderson U.S. Pat. No. 4,676,855 may be employed in the present invention. The Anderson process is similar to that of Colson, but differs in that one edge of the strip material is folded over the opposite side of the strip from the other edge. As applied to the present invention, one edge of the strip is shaped into the front wall flap portion over the opposite side of the strip from the side which the other edge is folded over. FIGS. 5*d*, 6, 8*a*–8*c* and 8*e*–8*f* show cell structures which fit this description.

Formation of the front wall flap portion may be achieved in any of several ways. First of all, the front wall flap portion may be left unshaped to hang freely. Alternatively, the front wall flap may be shaped during the strip-forming process of Colson or Anderson described above, in which case the front wall flap will already be formed when the strip material is stacked to construct the cellular assembly. If this method is used, the conventional methods must be modified to accommodate the need for a smoothly curved front wall flap substantially without creases. This primarily requires that the creaser assembly 20 and folding mechanism 23 of FIG. 9 be modified to bend the longitudinal front edge 46 of the material into the desired shape, without permanently creasing the material in any area of the front face of the shade which is visible when the shade is in use. If temporary creases are desired in the longitudinal front edge 46, then creaser assembly wheels 22 or 22' may be used for this purpose, the latter for the Anderson method of bending the edge over the opposite side of the strip than the rear edge. Where a simple, curved flap as shown in FIGS. 5*a*–5*c* and 8*a*–8*c* is desired, the rollers 25, 26, 28 and 29 of FIG. 9 would be modified to conform the edge of strip material to such a shape, and would preferably heat set the material as well. Where a loop is to be formed in the front wall flap portion, it is necessary to apply a bead of adhesive 44, shown in FIGS. 5*d*–5*f* and 8*d*–8*f*, to fasten the loop. This may be achieved in a number of ways which would be apparent to one skilled in the art, one of which would be the addition of a second adhesive application unit 30' to the apparatus of FIG. 9, located prior to the folding mechanism 23. After leaving the folding mechanism, the bond of the adhesive could be secured by pressure from rollers 25, 26, 28 and 29. FIGS. 10 and 11 show the strip material as it emerges from folding mechanism 23 when the Colson or Anderson process is used; respectively.

Alternatively, the front wall flap portion could be shaped subsequent to manufacture of the series of cells by the strip-forming process. Unshaped front wall flap strip edges according to this alternative are shaped around a die or dies while part of an otherwise complete expandable and contractible shade. FIG. 12 shows the strip material as it emerges from the folding mechanism 23 of FIG. 9 when this process is used.

In another alternative, the cell can be formed out of an extrudable plastic material. The method of forming the cells then comprises forming the cell directly by extrusion, rather than by folding a continuous strip of material. In some cases it might also be desirable to use both of these and/or other methods of forming the cells in manufacture of a single shade according to the invention, while maintaining a uniform appearance and satisfactory operational characteristics.

We claim:

1. An expandable and contractible shade member, comprising an assembly of parallelly arranged coplanar rear wall portions, with the longitudinal direction of said rear wall portions transverse to the direction of expansion and contraction of the shade member, each rear wall portion comprising:

a) an inturned top portion, b) an inturned bottom portion, and c) a main surface portion extending between the inturned top portion and the inturned bottom portion, one of said inturned top and bottom portions terminating in a first terminal edge, adjacent inturned top and bottom portions being adheringly connected to form a juncture between adjacent rear wall portions;

said shade member further comprising a plurality of freely hanging front wall portions, each said front wall portion drooping downwardly from an upper juncture to and beyond a directly adjacent lower juncture when said shade member is in the expanded state and terminating in a second terminal edge, and each said front wall portion being integral at its upper end with the inturned top portion or the intuned bottom portion of an adjacent one of said rear wall portions and individual from any of the other rear wall portions, wherein said front wall portions and said rear wall portions define a plurality of generally tubular cells arranged one on top of the other.

2. An expandable and contractible shade member, comprising an assembly of an integral row of parallelly arranged generally tubular cells one on top of the other, with the longitudinal cell axis transverse to the direction of expansion and contraction of the shade member, wherein said shade member is formed from a plurality of superimposed strips of flexible material, at least one cell comprising:

a) a top portion;

b) a bottom portion;

c) a rear wall portion extending between the top portion and the bottom portion; and d) a front wall portion, wherein the front wall portion comprises a hanging flap portion and said at least one cell comprises at least one longitudinal edge portion of one of said superimposed strips, the number of said strips being at least equal to the number of cells, said front wall flap portion defining in the expanded state a surface drooping downwardly from the top portion at least to a juncture of said cell with an immediately adjacent lower cell, with the height and shape of said front wall flap portion being independent of the juncture of said cell to the immediately adjacent lower cell.

3. The shade member of claim 2, wherein: the front wall flap portion of said cell terminates in a freely hanging edge.

4. The shade member of claim 3, wherein: the front wall flap portion of said cell is of a curved, scalloped shape.

5. The shade member of claim 3, wherein: the front wall flap portion of said cell is substantially straight, with a curved portion toward the bottom of the front wall flap so that the freely hanging edge points toward the rear of the shade.

6. The shade member of claim 2, wherein:

the front wall flap portion of said cell comprises a loop, with the material of said front wall flap portion doubled forwardly over itself and joined to itself in a loop shape.

7. The shade member of claim 2, wherein:

the front wall flap portion of said cell comprises a loop, with the material of said front wall flap portion doubled rearwardly over itself and joined to itself in a loop shape.

8. The window shade of claim 7, wherein:

one face of the material is joined to its other face to form a bulbous loop.

9. The shade member of claim 2, wherein:

the front wall flap portion of said cell comprises a loop, with the material of said front wall flap portion doubled over itself and joined to itself toward the top of said front wall flap portion.

10. The shade member of claim 2, wherein:

the front wall flap portion of said cell comprises a loop, with the material of said front wall flap portion doubled over itself and joined to itself toward the bottom of said front wall flap portion.

11. The shade member of any of claims 1 through 10, wherein: the front wall flap portion is freely hanging and independent of junctures with other parts of the cells.

12. The shade member of claim 2, wherein: the rear wall portion of said cell defines a substantially straight surface when said window shade is expanded.

13. The shade member of claim 12, wherein: a permanent longitudinal crease is formed in the rear wall portion of said cell to guide and control its expansion and contraction.

14. The shade member of any of claims 1 through 10, 12, or 13, wherein: said cell of the assembly is defined by one strip of material.

15. The shade member of any of claims 1 through 10, 12 or 13, wherein: said cell of the assembly is defined by two strips of material, each of said two strips forming portions of two immediately adjacent cells.

16. The shade member of claim 11, wherein: said cell of the assembly is defined by one strip of material.

17. The shade member of claim 11, wherein: said cell of the assembly is defined by two strips of material, each of said two strips forming portions of two immediately adjacent cells.

18. The shade member of claim 11, wherein: said at least one cell comprises a front wall flap portion and a top front portion defined by a first strip of material, and a top rear portion, rear wall portion, and bottom portion defined by a second strip of material.

19. The shade member of any of claims 1 through 10, 12 or 13, further comprising:

a) a head rail being connected to an uppermost one of said cells;

b) a bottom rail being connected to a lowermost one of said cells;

c) control cord means for expanding and contracting said shade.

20. The shade member of claim 11, further comprising:

a) a head rail being connected to an uppermost one of said cells;

b) a bottom rail being connected to a lowermost one of said cells;

c) control cord means for expanding and contracting said shade.

* * * * *